US009067117B1

(12) United States Patent
Chacon

(10) Patent No.: US 9,067,117 B1
(45) Date of Patent: Jun. 30, 2015

(54) GOLF SWING IMPROVEMENT DEVICE

(71) Applicant: Raul Chacon, Laytonsville, MD (US)

(72) Inventor: Raul Chacon, Laytonsville, MD (US)

( * ) Notice: Subject to any disclaimer, the term of this patent is extended or adjusted under 35 U.S.C. 154(b) by 0 days.

(21) Appl. No.: 14/155,072

(22) Filed: Jan. 14, 2014

(51) Int. Cl.
*A63B 69/36* (2006.01)

(52) U.S. Cl.
CPC ..... *A63B 69/3641* (2013.01)

(58) Field of Classification Search
USPC ..... 473/257, 258, 261, 262, 265, 266, 270, 473/278
See application file for complete search history.

(56) References Cited

U.S. PATENT DOCUMENTS

| | | | | | |
|---|---|---|---|---|---|
| 1,175,070 | A | * | 3/1916 | Maxwell | 312/231 |
| 1,922,735 | A | * | 8/1933 | Johnson | 473/148 |
| 1,973,283 | A | * | 9/1934 | Buttrick | 190/111 |
| 3,874,673 | A | * | 4/1975 | Beard | 473/262 |
| 4,875,685 | A | * | 10/1989 | Ballinger et al. | 473/262 |
| 5,263,719 | A | | 11/1993 | Bunn | |
| 5,332,211 | A | * | 7/1994 | Rife et al. | 473/258 |
| 5,362,057 | A | * | 11/1994 | Arima | 473/265 |
| 5,458,336 | A | | 10/1995 | Miller | |
| 5,659,929 | A | * | 8/1997 | Cheng | 16/366 |
| 6,155,931 | A | | 12/2000 | Perrine | |
| 7,104,900 | B1 | | 9/2006 | Finley | |
| 7,238,118 | B1 | | 7/2007 | Terrill | |
| 7,744,482 | B1 | * | 6/2010 | Watson | 473/221 |
| 8,157,667 | B2 | | 4/2012 | Tome et al. | |
| 2002/0115496 | A1 | | 8/2002 | Day et al. | |
| 2005/0096147 | A1 | * | 5/2005 | Schmidt | 473/278 |
| 2006/0240902 | A1 | | 10/2006 | Jordan | |

FOREIGN PATENT DOCUMENTS

| | | | |
|---|---|---|---|
| WO | 9965574 | A | 12/1999 |
| WO | 2010117192 | A | 10/2010 |

* cited by examiner

*Primary Examiner* — Nini Legesse
(74) *Attorney, Agent, or Firm* — The Law Firm of Andrea Hence Evans, LLC

(57) ABSTRACT

The invention features a golf swing improvement device meant to improve a golf player's game. The device includes a first and second member connected with each other by way of a hinge portion. Extrusions extending from an outer wall of the first member protect the device from being hit by a player's dub during play, practice or while putting. The device also contemplates a configuration to enable use of golf alignment devices and/or sticks.

7 Claims, 5 Drawing Sheets

GOLF SWING IMPROVEMENT DEVICE

FIELD OF THE INVENTION

The present invention relates, in general, to a device for improving a golf player's swinging ability.

BACKGROUND OF THE INVENTION

As many golf players can attest, one of the most challenging aspects of the game of golf is the perfection of a player's swinging ability. With a better swing, players are able to drive their golf balls in the direction and to the desired distance during their game. In addition, players also need a device that: would aid them during practice or as a putting aide on any practice green. The device, as contemplated in the present invention, seeks to address these concerns/needs.

SUMMARY OF THE INVENTION

The present invention provides a portable golf swing aide designed to guide a golf is player's proper swing plane when practicing his/her golf swing at a golf driving range during normal practice or before playing a round of golf.

Advantages of the device as contemplated in the present invention include the reinforcement of golf instructions given, by a golf professional. This aids new players during and after their golf game learning sessions.

Another advantage of the device contemplated in the present invention is that it eliminates out-of-plane swings which cause slices. In addition, the device, as contemplated in the present invention, eliminates over the top swings.

A player using the device would improve their ball striking by approaching the impact zone from the inside. Closed clubfaces, which cause shanks are also eliminated.

The device, as contemplated in the present invention, also puts a player on the right track to achieving straighter shots as the device provides a proper guide for swings.

Use of the device also tends to lower a player's handicap and provides the player with greater confidence in their game.

An aspect of an embodiment of the invention provides a golf swing improvement device having a first member, a second member and a hinge. In one aspect of an embodiment of the present invention, the first member may have inner and outer walls, where the outer will faces a golf player's golf swing. In one aspect of an embodiment of the present invention, the second member may have a top surface, a bottom surface and multiple side surfaces. The hinge portion, according to an aspect of an embodiment of the present invention, may have one arm mounted on the inner wall of the first member and its second arm mounted on the top surface of the second member, thereby connecting the first and second members. The hinge's second arm may be perpendicularly adjacent to one of the multiple side surfaces of the second member.

In another aspect of an embodiment of the present invention, the bottom surface of the second member may have an alignment trough configured to be used with an alignment device or alignment sticks.

The golf swing improvement device, in another aspect of an embodiment of the present invention, may also include a plurality of extrusions which may extend perpendicularly from the outer wall of the first member. In one aspect, these extrusions protect the outer wall of the first member from the golf player's club when striking a golf ball in another aspect of an embodiment of the present invention, the extrusions may be pliable, thereby allowing them to bend and return to their original position and/or shape in case the player's golf club makes contact with them during practice or play.

The hinge of the golf swing improvement device, in yet another aspect of an embodiment of the present invention, may, when fully opened, enable a portion of the inner wall of the first member to be perpendicularly flush with one of the multiple side surfaces of the second member. This may be made possible, in one aspect, by properly positioning the hinge's arms.

In yet another aspect of an embodiment of the present invention, either or both of the first and second members may be rectangular in shape.

In yet another aspect of an embodiment of the present invention, the first and second members may be equal in some or all physical dimensions.

Additional aspects objectives, features and advantages of the present invention will become apparent from the following description of the preferred to embodiments with reference to the attached drawings.

DETAILED DESCRIPTION OF THE INVENTION

Figure 1:
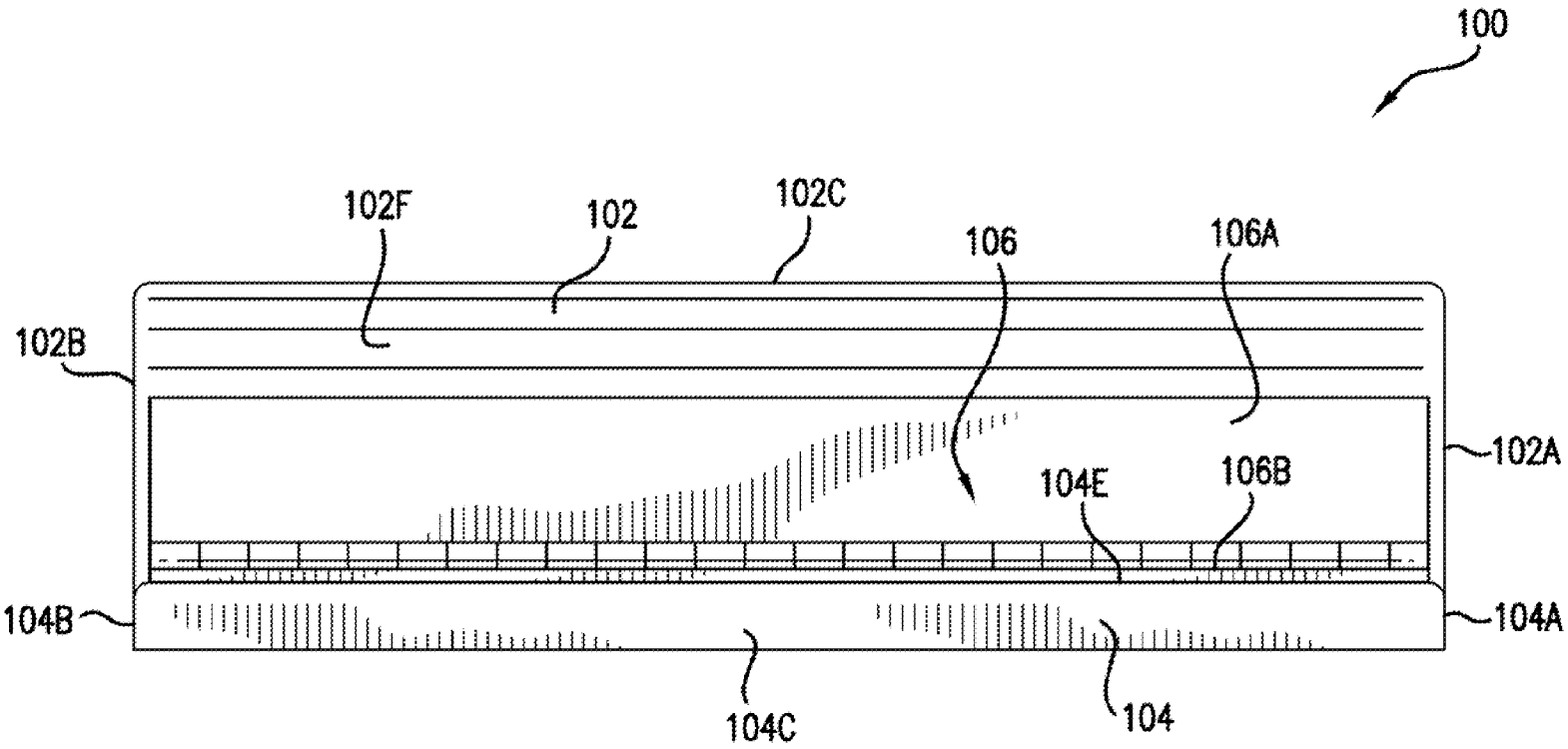
FIG. 1 illustrates a back view of the golf swing improvement device according to an aspect of an embodiment of the present invention.
Figure 2:
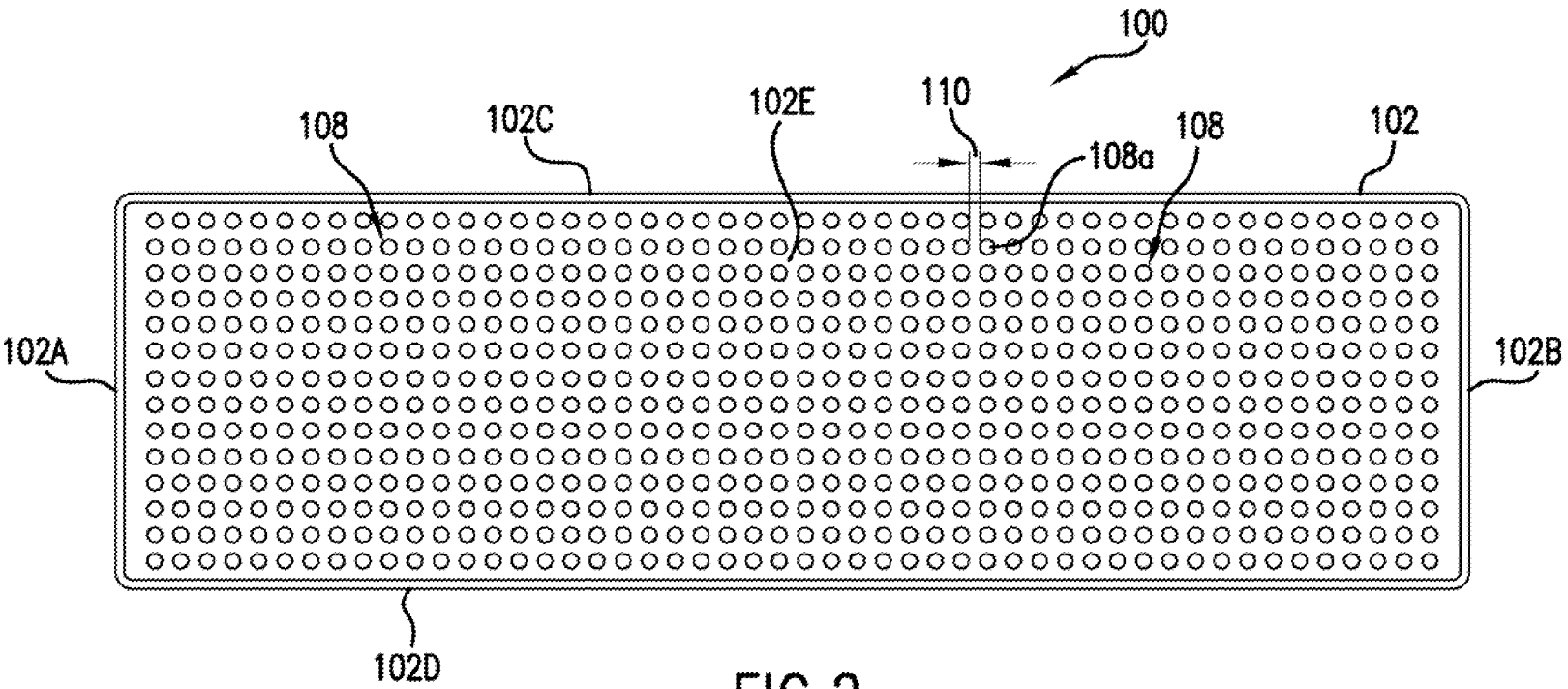
FIG. 2 illustrates a front view of the opened golf swing improvement device according to an aspect of an embodiment of the present invention.
Figure 3:
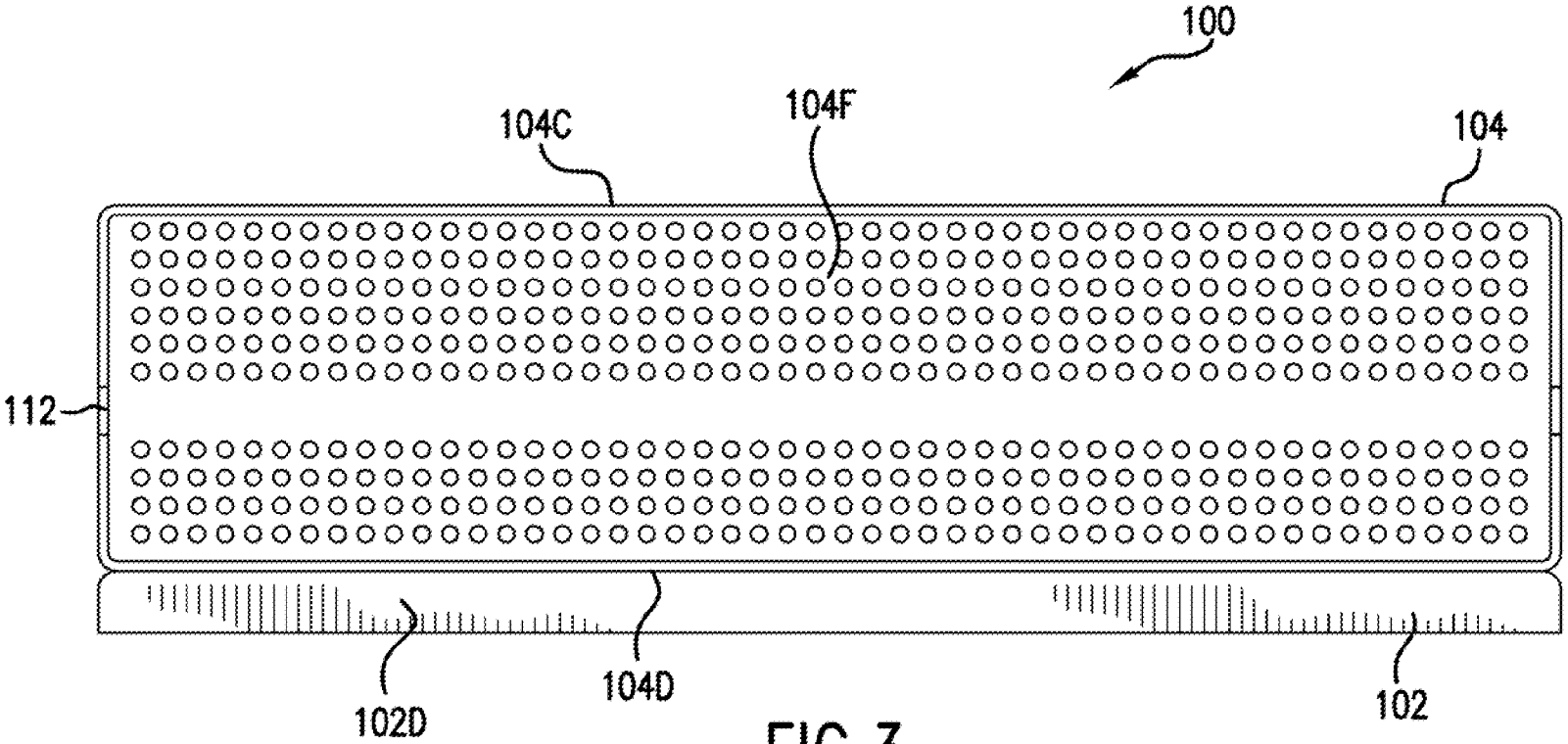
FIG. 3 illustrates a bottom view of the golf swing improvement device according to an aspect of an embodiment of the present invention.

Referring now to FIGS. 1 through 4, back, front, bottom and side views of golf swing improvement device 100, according to an aspect of an embodiment of the present invention, are shown. Golf swing improvement device 100 is shown with first member 102 which is connected with second member 104 by way of hinge 106. First member 102 has top and bottom edges 102A & 102B, side edges 102C & 102D (FIG. 2). First member 102 also has outer wall 102E (FIG. 2). Second member 104 also has top and bottom edges 104A & 104B, side edges 104C & 104D (FIG. 3). Second member 104 may also have top and bottom surfaces 104E & 104F (FIG. 3). Hinge 106 may, in one aspect of an embodiment of the present invention, connect first and second members 102 and 104 by way of first and second arms 106A and 106B of hinge 106 as shown. Hinge 106 may be so connected with first and second members 102 and 104 by methods or means known in the art. For the golf player to use golf swing improvement device 100, he/she would have to open the device as shown having the hinge side opposite to the player's swing.

Referring specifically now to FIG. 2, a front view of the opened golf swing improvement device 100 according to an aspect of an embodiment of the present invention, is shown. Here, multiple extrusions 108 are shown to extend from the outer wall 102E of first member 102. In one aspect of an embodiment of the present invention, extrusions 108 may extend perpendicularly from the face of outer wall 102E. Extrusions 108 are positioned along outer wall 102E such that they cover the surface of outer wall 102E. Each extrusion 108*a* has a small space 110 between them keeping them uniformly positioned along outer wall 102E. In another aspect, they may be pliable thereby enabling them to bend and return to their original position when hit by the player's golf club during practice or play. Extrusions 108 also help to protect the club from damage if it strikes the extrusions.

Referring specifically now to FIG. 3, a bottom view of the golf swing improvement device 100 according to an aspect of an embodiment of the present invention, is shown. Here, bottom surface 104F of second member 104 is shown with an alignment trough 112. In one aspect of an embodiment of the present invention, alignment trough 112 may be a rectangular channel within second member 104 which may run the length of bottom surface 104F of second member 104. In another aspect, alignment trough may be centrally located within the length of second member 104. Alignment trough 112 may be configured to be used with an alignment device or alignment sticks (not shown) to align golf swing improvement device 100 during play, putting or practice.

Figure 4:
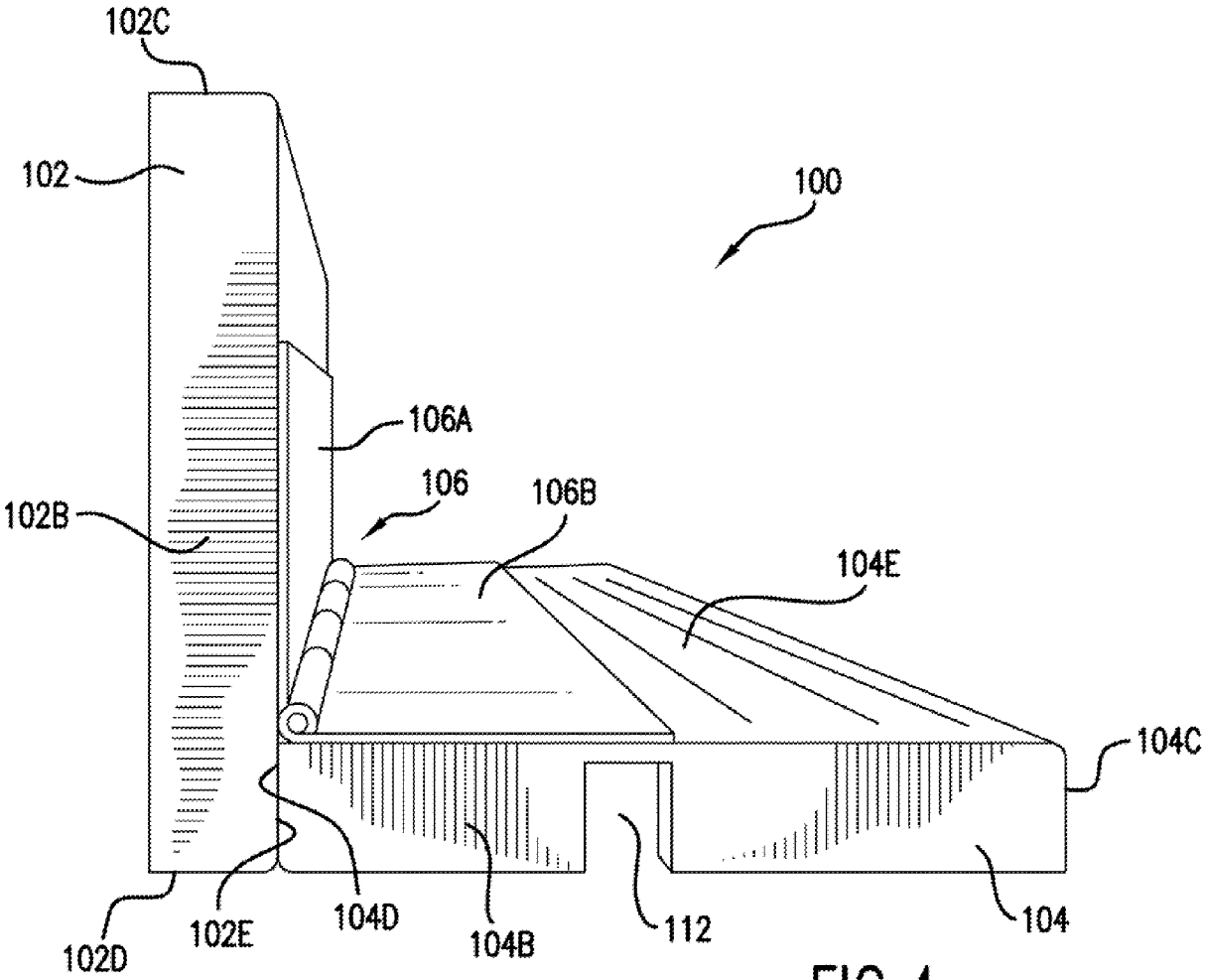
FIG. 4 illustrates a side view of the golf swing improvement device according to an aspect or an embodiment of the present invention.

Referring specifically now to FIG. 4, a side view of the golf swing improvement device 100 according to an aspect of an embodiment of the present invention, is shown. Here, outer wall 102E of first member is shown flush with side edge 104D of second member 104. This may be made possible by properly positioning arms 106A and 106B of hinge 106 whereby, in one aspect of an embodiment of the present invention, arm 106B may be positioned perpendicularly adjacent to side edge 104D of second member 104. Also in this figure, alignment trough 112 is shown beginning from top edge 104A to bottom edge 104B of second member 104, thereby extending through, in one aspect of an embodiment of the present invention, the length of second member 104. In another aspect of an embodiment of the present invention, alignment trough 112 may not run the entire length of second member 104 but may rather have a shorter length. In yet another aspect of an embodiment of the present invention, there may be more than one alignment trough each separated from each other by portions of second member 104.

Figure 5:
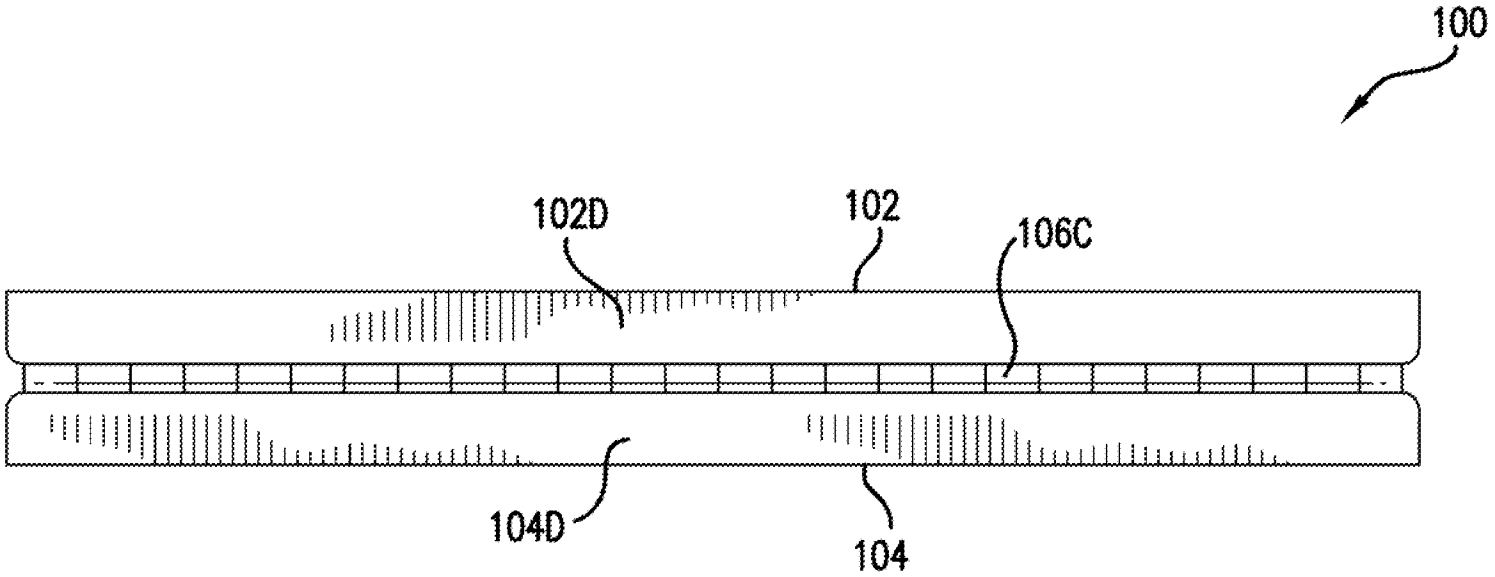
FIG. 5 illustrates a front view of the closed golf swing improvement device according to an aspect of an embodiment of the present invention.

Referring now to FIG. 5, a front view of the closed golf swing improvement device 100 according to an aspect of an embodiment of the present invention, is shown. Here, the length of side edge 104D of second member 104 is shown along with the spine 106C of hinge 106 and first member 102. In one aspect of an embodiment of the present invention, first and second members 102 and 104 of golf swing improvement device 100 may be equally dimensioned. Their dimensions, in another aspect of an embodiment of the present invention, may also be, depending on application, differently dimensioned.

A player using golf swing improvement device 100 may position the golf ball on the same side as the player's swing i.e. at a. position parallel and close to the outer wall of first member 102. By opening golf swing improvement apparatus 100 to the maximum possible position i.e. when outer wall 102E of first member 102 is perpendicularly flush with side edge 104D of second member 104, the player may use device 100 as a visual guide in determining how close or how high to swing his/her club in hitting the ball. The player may also be able to train his/her swing to properly swing his/her club to effectively hit the ball in order to achieve a desired direction and distance. Where the player swings too dose to device 100, the club may then hit or graze extrusions 108 which extend from outer wall 102E of first member 102. These extrusions, being pliable in one aspect of an embodiment of the present invention, may subsequently return to their original shape and position. If the player's swing is too close to outer wall 102*e*, the wall 102*e* will rotate around the hinge 106 and move from its original perpendicular position. The player can manually reposition the wall 102*e* to its original position. Also, the player can identify the accuracy of the swing based on the movement of the outer wall 102*e*.

A player seeking to use alignment devices such as alignment sticks or rails may do so with golf swing improvement device 100 whereby alignment trough 112 is specifically designed to fit or connect with such alignment devices.

Once the player is done playing or practicing, he/she may then fold golf swing improvement device 100 (made possible by hinge 106C) and easily transport improvement device 100.

Although this present invention has been disclosed with reference to specific forms and embodiments, it will be evident that a great number of variations may be made without departing from the spirit and scope of the present invention. For example, equivalent elements may be substituted for those specifically disclosed and certain features of the present invention may be used independently of other features—all without departing from the present invention as defined in the appended claims.

What is claimed is:

1. A golf swing improvement device, comprising:

a first member having an inner wall and an outer wall, wherein said outer wall faces a golf player's golf swing;

a second member having a top surface, a bottom surface and multiple side surfaces;

a hinge, having one arm mounted on said inner wall of said first member and a second arm mounted on said top surface of said second member, connecting said first and second members, wherein said second arm of said hinge is perpendicularly adjacent to one of said multiple side surfaces of said second member; and further comprising a plurality of extrusions extending perpendicularly from said outer wall of said first member, wherein said plurality of extrusions protect said outer wall of said first member from said golf player's club when striking a golf ball.

2. The golf swing improvement device according to claim 1, wherein said bottom surface of said second member comprises of an alignment trough configured to he used with an alignment device.

3. The golf swing improvement device according to claim 1, wherein said plurality of extrusions are pliable.

4. The golf swing improvement device according to claim 1, wherein said hinge, when opened, enables a portion of said inner wall of said first member to be perpendicularly flush with one of said multiple side surfaces of said second member.

5. The golf swing improvement device according to claim 1, wherein said first member is rectangular.

6. The golf swing improvement device according to claim 1, wherein said second member is rectangular.

7. The golf swing improvement device according to claim 1 wherein said first and second members are equal in physical dimension.

* * * * *